US010616960B2

(12) United States Patent
Yasutake

(10) Patent No.: US 10,616,960 B2
(45) Date of Patent: Apr. 7, 2020

(54) HEATING COIL

(71) Applicant: NETUREN CO., LTD., Tokyo (JP)

(72) Inventor: Hidehiro Yasutake, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 313 days.

(21) Appl. No.: 15/315,939

(22) PCT Filed: Aug. 4, 2015

(86) PCT No.: PCT/JP2015/003926
§ 371 (c)(1),
(2) Date: Dec. 2, 2016

(87) PCT Pub. No.: WO2016/021189
PCT Pub. Date: Feb. 11, 2016

(65) Prior Publication Data

US 2017/0099703 A1 Apr. 6, 2017

(30) Foreign Application Priority Data

Aug. 5, 2014 (JP) ..... 2014-159404

(51) Int. Cl.
*H05B 6/38* (2006.01)
*H05B 6/10* (2006.01)
*H05B 6/42* (2006.01)

(52) U.S. Cl.
CPC ..... *H05B 6/38* (2013.01); *H05B 6/101* (2013.01); *H05B 6/42* (2013.01)

(58) Field of Classification Search
CPC . H05B 6/101; H05B 6/38; H05B 6/42; H05B 6/40; H05B 6/44
USPC ..... 219/635, 643, 644, 632; 392/320
See application file for complete search history.

(56) References Cited

U.S. PATENT DOCUMENTS 3,258,573 A 6/1966 Morin et al.
4,698,473 A 10/1987 Alcini et al.
6,043,472 A * 3/2000 Bruckner ..... B22D 41/14 219/632

(Continued)

FOREIGN PATENT DOCUMENTS

DE 198 43 087 3/2000
JP 07-242933 9/1995

(Continued)

OTHER PUBLICATIONS https://www.mathsisfun.com/geometry/cross-sections.html.*

(Continued)

*Primary Examiner* — Michael G Hoang
(74) *Attorney, Agent, or Firm* — Wenderoth, Lind & Ponack, L.L.P.

(57) ABSTRACT

A heating coil is configured to inductively heat an inner surface of a tubular workpiece. The heating coil includes a head portion configured to be inserted into the workpiece and to inductively heat the inner surface of the workpiece, and a pair of lead portions connected to one end of the head portion and the other end of the head portion respectively. The head portion and the lead portions are configured as pipe members forming a series of flow channels through which coolant flows. A cross-sectional area of the flow channel inside each of the lead portion is greater than a cross-sectional area of the flow channel inside the head portion.

9 Claims, 6 Drawing Sheets

(56) References Cited

U.S. PATENT DOCUMENTS

| | | | | |
|---|---|---|---|---|
| 2001/0004631 | A1 | 6/2001 | Enomoto et al. | |
| 2013/0140299 | A1 | 6/2013 | Kiyosawa et al. | |
| 2014/0308433 | A1* | 10/2014 | Ouellette ..... | B29C 70/32 427/8 |

FOREIGN PATENT DOCUMENTS

| | | | |
|---|---|---|---|
| JP | 2001-172716 | | 6/2001 |
| JP | 2013051182 | A * | 3/2013 |
| JP | 2013-140774 | | 7/2013 |
| JP | 2013-170287 | | 9/2013 |

OTHER PUBLICATIONS

Khan Academy Non-Patent Literature, published in 2012.*
Chandratilleke et al. Non-Patent Literature, published in 2012.*
Japanese to English machine translation of Inaba, published in 2013.*
International Search Report dated Nov. 6, 2015 in International Application No. PCT/JP2015/003926.
Written Opinion of the International Searching Authority dated Nov. 6, 2015 in International Application No. PCT/JP2015/003926.

* cited by examiner

| | TEST EXAMPLE 1 | TEST EXAMPLE 2 | TEST EXAMPLE 3 |
|---|---|---|---|
| LEAD PORTION CROSS SECTION |   |   |   |
| COOLANT FLOW RATE (L/min) | 2.5 | 4.0 | 6.5 |

HEATING COIL

TECHNICAL FIELD

The present invention relates to a heating coil for induction heating of an inner surface of a tubular workpiece.

BACKGROUND ART

A heating coil for induction heating of an inner surface of a tubular workpiece typically includes a head portion configured to be inserted into the workpiece to inductively heat the inner surface of the workpiece and a pair of lead portions connected to one end of the head portion and the other end of the head portion respectively.

The head portion and the lead portions are formed by using pipe members, forming a series of flow channels through which coolant flows. According to related art heating coils, a head portion and lead portions are formed by using same pipe members (for example, see JP 2001-172716 A and JP 2013-170287 A).

The frequency of power supplied to a heating coil has a proper range which varies depending on the dimension of a workpiece, heating specifications, and the like. However, when various workpieces are heated with various heating specifications using a single equipment, the heating may sometimes have to be performed at a frequency lower than the proper range corresponding to the dimension of a workpiece or the heating specifications.

In induction heating of an inner surface of a tubular workpiece, there is a tendency that heating efficiency becomes lower as the frequency of AC power supplied to the heating coil becomes lower.

When power supplied to the heating coil increases to compensate for the lowering in heating efficiency, an amount of heat generated from the heating coil also increases. The heating coil is cooled using coolant flowing therein, but the flow rate of the coolant is limited, for example, by the shape of the flow channel inside the lead portions, and thus the heating coil may not be sufficiently cooled and may be deteriorated rapidly.

SUMMARY OF INVENTION

The present invention have been made in view of the circumstances described above, and it is an object thereof to provide a heating coil that can increase a flow rate of coolant.

According to an aspect of the present invention, a heating coil is configured to inductively heat an inner surface of a tubular workpiece. The heating coil includes a head portion configured to be inserted into the workpiece and to inductively heat the inner surface of the workpiece, and a pair of lead portions connected to one end of the head portion and the other end of the head portion respectively. The head portion and the lead portions are configured as pipe members forming a series of flow channels through which coolant flows. A cross-sectional area of the flow channel inside each of the lead portion is greater than a cross-sectional area of the flow channel inside the head portion.

DESCRIPTION OF EMBODIMENTS

Hereinafter, an embodiment of the present invention will be described with reference to the drawings.

Figure 1:
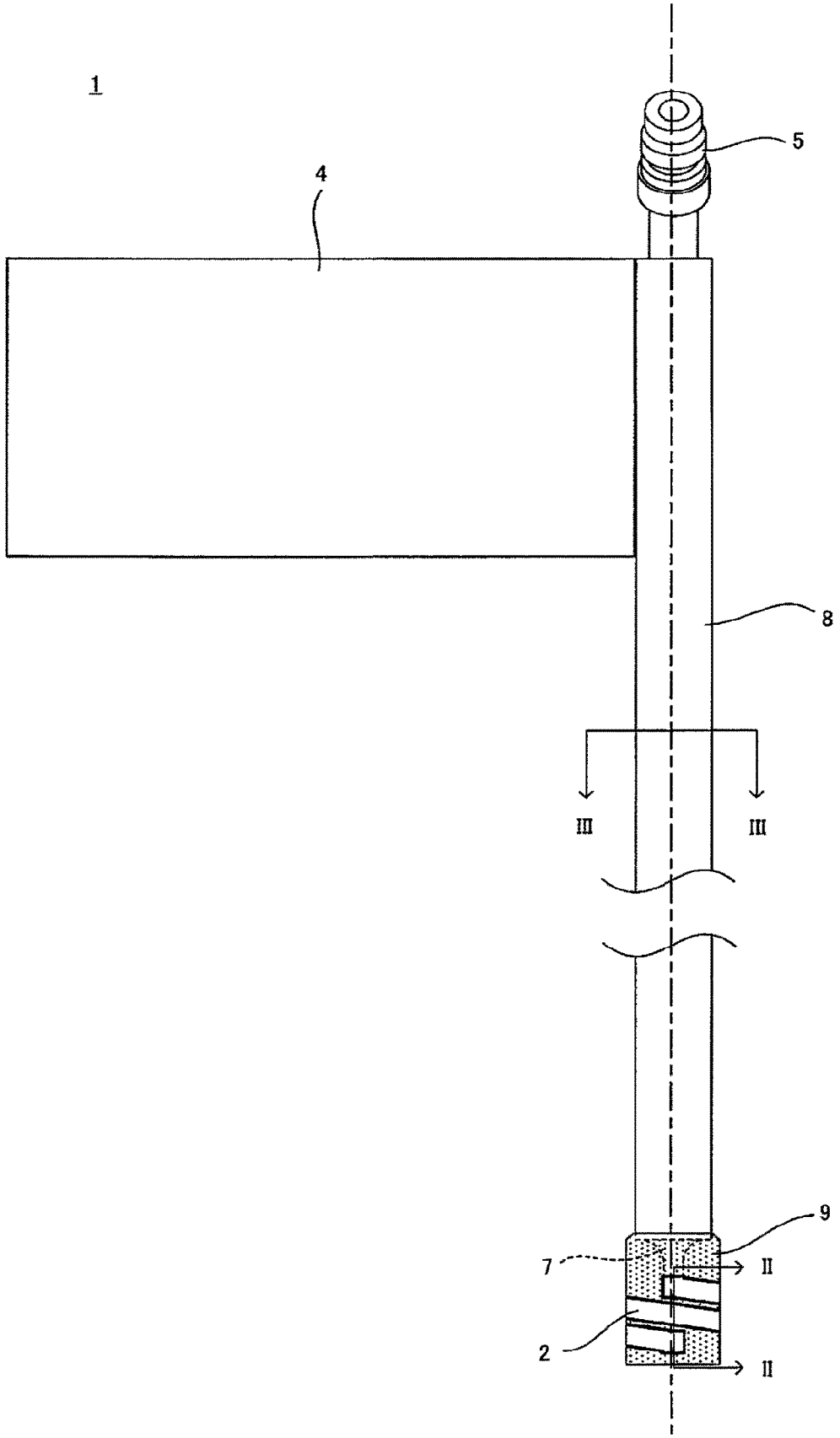
FIG. 1 is a diagram illustrating a configuration of an example of a heating coil according to an embodiment of the present invention.
Figure 2:
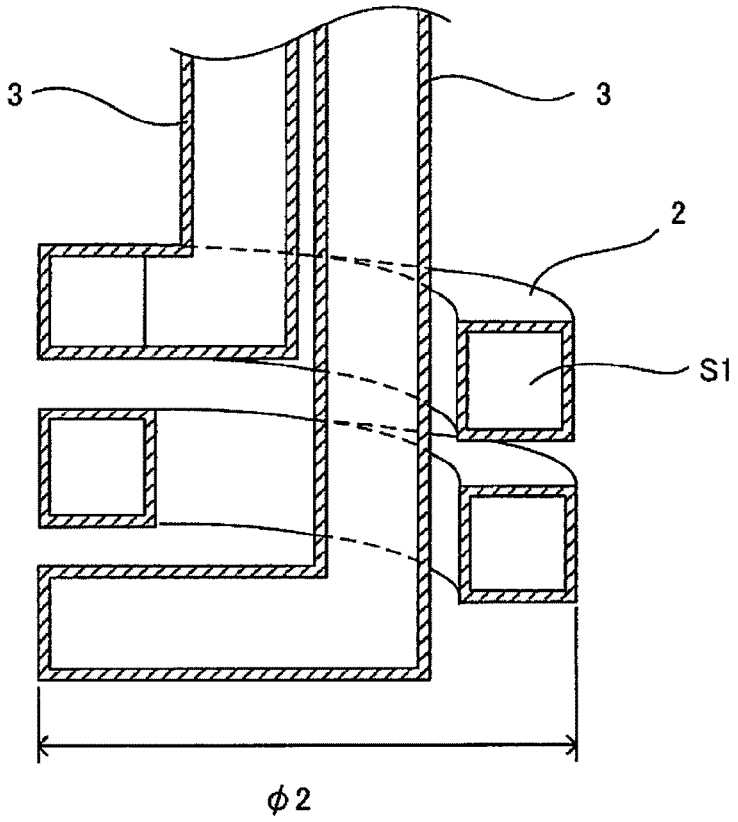
FIG. 2. is a cross-sectional view of a pair of lead portions of the heating coil taken along the line II-II of FIG. 1.
Figure 3:
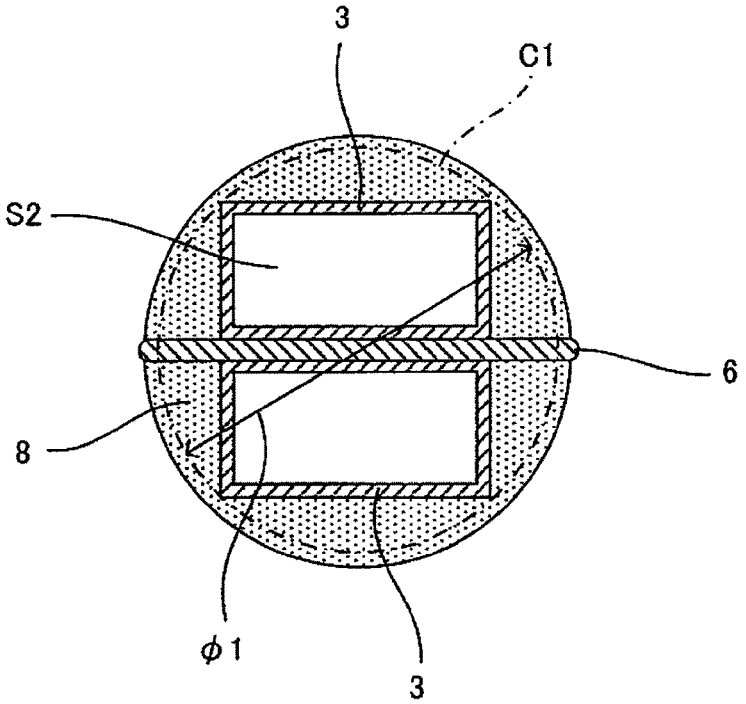
FIG. 3. is a cross-sectional view of the pair of lead portions of the heating coil taken along the line III-III of FIG. 1.
Figure 4A:
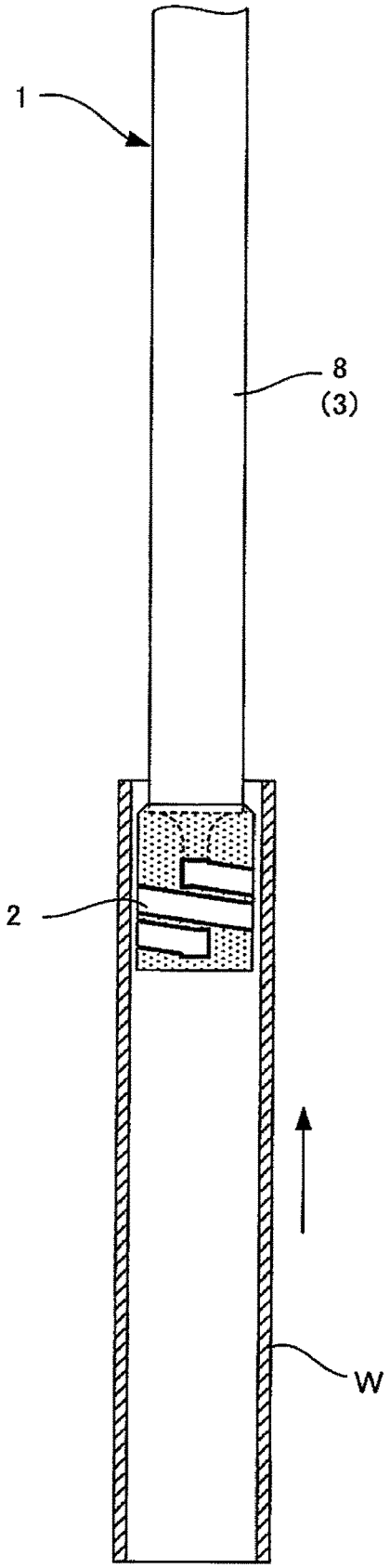
FIG. 4A is a diagram illustrating a usage example of the heating coil illustrated in FIG. 1.
Figure 4B:
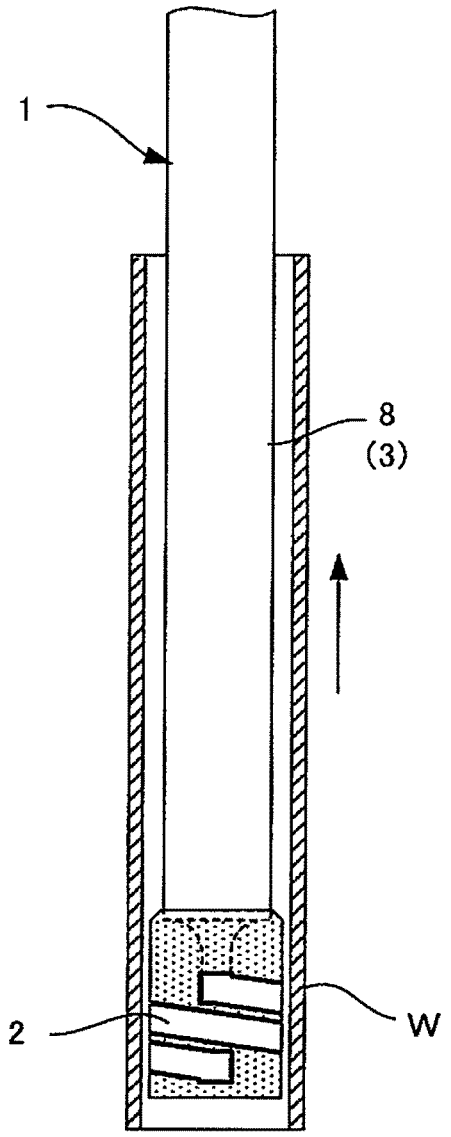
FIG. 4B is another diagram illustrating a usage example of the heating coil illustrated in FIG. 1.

FIGS. 1 to 3 illustrate a configuration of an example of a heating coil according to an embodiment of the invention, and FIGS. 4A and 4B illustrate a usage example of the heating coil illustrated in FIG. 1.

The heating coil 1 illustrated in FIG. 1 is used for induction heating of an inner surface of a tubular workpiece W. The heating coil 1 includes a head portion 2 configured to be inserted into the workpiece W and to inductively heat the inner surface of the workpiece W, and a pair of lead portions 3 connected to one end of the head portion 2 and the other end of the head portion 2 respectively.

In the illustrated example, the head portion 2 is formed by spirally winding a pipe member having a substantially rectangular cross-section. The head portion 2 is formed depending on the dimension of a workpiece, heating specifications, and the like, and the configuration of the head portion 2 (e.g., how a pipe member is wound and the number of windings) may be changed as appropriate.

One of the lead portions 3 is connected to one end of the head portion 2 which has been spirally wound. The other lead portion 3 is inserted through the head portion 2 and is connected to the other end of the head portion 2.

The head portion 2 and the lead portions 3 are formed by using conductive metal pipes such as copper pipes and form a series of flow channels inside which coolant flows. Typically, water is used as the coolant.

The pair of lead portions 3 is connected to a power supply unit (not illustrated) supplying AC power to the heating coil 1 via the connecting plates 4 provided on the respective lead portions 3. The pair of lead portions 3 is connected to a coolant supply unit (not illustrated) supplying a coolant via a joint 5 formed at ends thereof. The heating coil 1 emitting heat with the supply of AC power from the power supply unit is cooled by the coolant supplied from the coolant supply unit and flowing in the heating coil 1.

As illustrated in FIGS. 4A and 4B, the heating coil 1 is used for moving heating of the inner surface of the workpiece W. In a state in which the heating coil 1 is supplied with AC power, the workpiece W moves in an axial direction. With the movement of the workpiece W, the head portion 2 relatively moves in the workpiece W along the central axis of the workpiece W and the inner surface of the workpiece W is inductively heated continuously in the relative moving direction of the head portion 2.

In the heating coil 1 used for the moving heating, the pair of lead portions 3 is also formed to be inserted into the workpiece W. The pair of lead portions 3 extends in a straight line shape in parallel to each other with an insulating plate 6 interposed therebetween along the central axis of the head portion 2, is longer in the extending direction than the head portion 2, and is formed in a relatively long shape.

The flow rate of the coolant flowing in the heating coil 1 is restricted, for example, by the shape of the flow channel in the lead portions 3. Particularly, in the heating coil 1 used for the moving heating, the flow channels inside the relatively-long lead portions 3 greatly affects the flow rate of the coolant.

Therefore, different pipe members may be used for the head portion 2 and the lead portions 3 of the heating coil 1 so that a cross-sectional area S2 of the flow channel inside each of the lead portions 3 is greater than a cross-sectional area S1 of the flow channel inside the head portion 2. In the illustrated example, the pipe member used for the lead portions 3 has a substantially rectangular cross-section and the pair of lead portions 3 has a substantially square cross-section as a whole.

By setting the cross-sectional area of the flow channel of each of the lead portions 3 to be relatively large, it is possible to suppress pressure loss in the lead portions 3 and to increase the flow rate of the coolant flowing in the heating coil 1 even when the supply pressure of the coolant is the same. In the heating coil 1 in which a pair of lead portions 3 is formed to be relatively long, the suppressing of pressure loss in the lead portions 3 is particularly useful for increasing the flow rate of the coolant.

The cooling of the heating coil 1 can be promoted by increasing the flow rate of the coolant flowing in the heating coil 1. Accordingly, for example, in induction heating at a frequency lower than a proper range, it is possible to compensate for a decrease in heating efficiency due to a low frequency by increasing the power supplied to the heating coil 1, and it is possible to prevent overheating of the heating coil 1, thereby suppressing degradation of the heating coil 1.

The heating efficiency tends to decrease as the inside dimension of the workpiece becomes smaller. Therefore, even when the workpiece W has a relatively small diameter, it is possible to compensate for a decrease in heating efficiency by increasing the power supplied to the heating coil 1, and it is possible to prevent overheating of the heating coil 1, thereby suppressing degradation of the heating coil 1. The invention can be suitably applied when the inner diameter of the workpiece W, that is, the outer diameter of the head portion 2, is equal to or less than φ50 mm.

The lead portions 3 and the head portion 2 may be connected directly to each other, but from the viewpoint of reducing pressure loss, it is advantageous to provide tapered connecting portions 7 between the head portion 2 and each of the lead portions 3, such that the cross-sectional area of the flow channel inside each of the connecting portions 7 is gradually reduced toward the head portion 2 as illustrated in the drawing. By this configuration, the flow of the coolant from the lead portion 3 on the coolant supply side to the head portion 2 and the flow of the coolant from the head portion 2 to the lead portion 3 on the coolant discharge side are smoothed and it is thus possible to further suppress the pressure loss in the lead portions 3.

It is preferable that the connecting portions 7 between the head portion 2 and each of the lead portions 3 be covered and reinforced with a reinforcing material 9 having heat resistance. For example, heat-resistant adhesive can be used as the reinforcing material 9, and the connecting portion 7 may be reinforced to enhance the heating efficiency using a high-permeability clayey material by filling the periphery of the connecting portion 7 and the head portion 2 with the high-permeability material so as to expose the outer surface of the head portion 2 as illustrated in the drawing.

By increasing the cross-sectional area of the flow channel inside each of the lead portions 3, it is possible to increase the second moment of area of each of the lead portions 3 and thus to enhance the rigidity.

In the heating coil 1, the pair of lead portions 3 is inserted into the workpiece W. In this case, an alternating magnetic field is formed around the lead portions 3 by an AC current flowing in the lead portions 3 and an eddy current is generated in the workpiece W by the alternating magnetic field. A Lorentz force acts on the lead portions 3 by interaction of the eddy current generated in the workpiece W and the current flowing in the lead portions 3, and thus the lead portions 3 vibrate. Accordingly, in the heating coil 1 in which a pair of lead portions 3 is inserted into the workpiece W, the increasing of the second moment of area of the lead portions 3 to enhance the rigidity is particularly useful for suppressing the vibration. In the illustrated example, the pair of lead portions 3 is auxiliarily covered with the reinforcing material 8 such as glass epoxy, but the reinforcing material 8 may not be provided depending on the rigidity of the lead portions 3.

When a pair of lead portions 3 is inserted into the workpiece W, it is preferable that the diameter φ1 of a smallest enclosing circle C1 enclosing the pair of lead portions 3 in a cross-section perpendicular to the extending direction of the lead portions 3 be smaller than the diameter (the outer diameter φ2 of the head portion 2 in the illustrated example) of a smallest enclosing circle which is concentric with the smallest enclosing circle C1 and encloses the head portion 2. Accordingly, the gap between the inner surface of the workpiece W and the lead portion 3 is greater than the gap between the inner surface of the workpiece W and the head portion 2 and it is thus possible to reduce an influence of the alternating magnetic field formed around the lead portions 3 on the induction heating of the workpiece W. As a result, it is possible to suppress a decrease in heating efficiency of the induction heating using the head portion 2.

Figure 5:
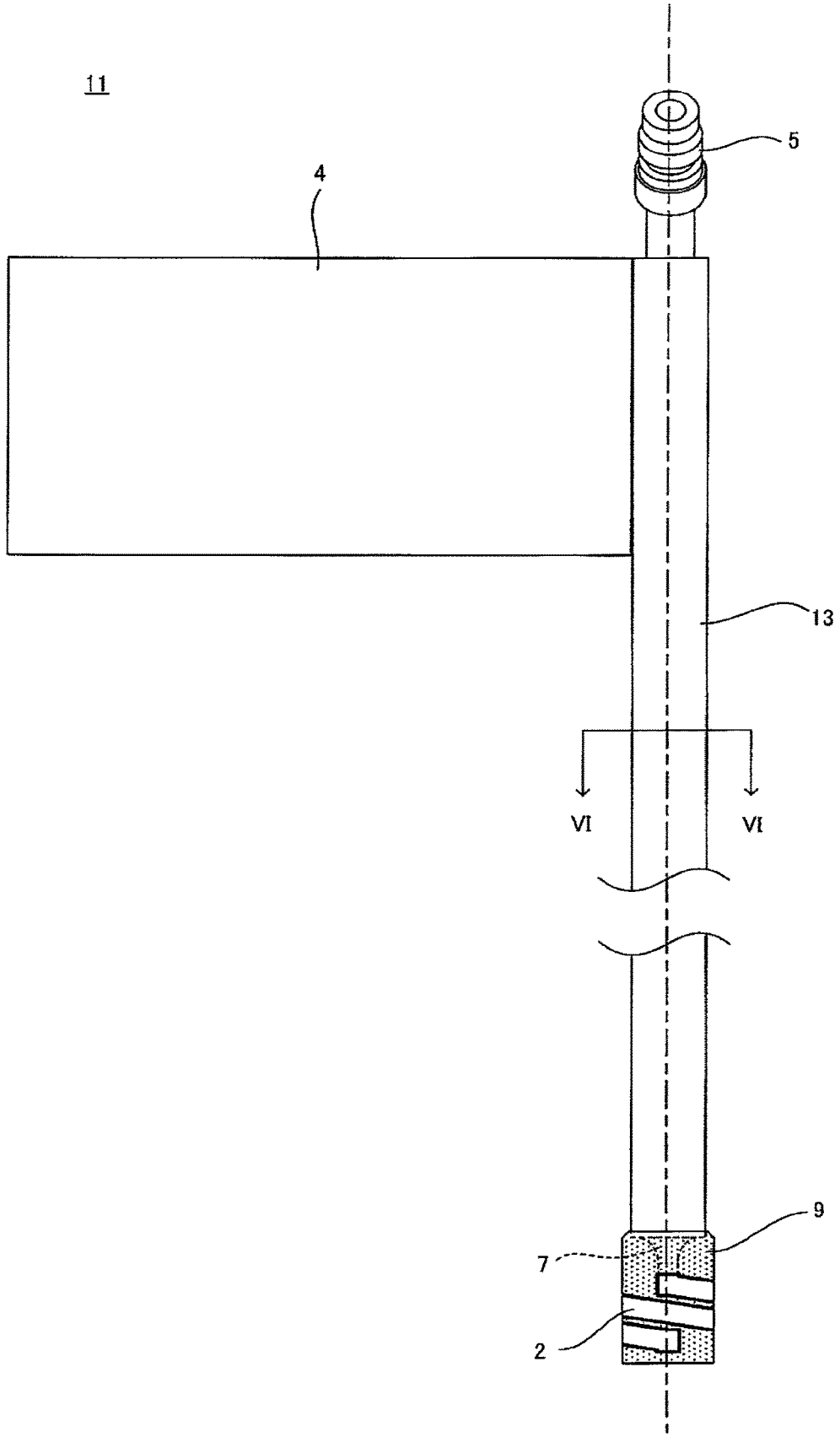
FIG. 5 is a diagram illustrating a configuration of another example of a heating coil according to the embodiment of the present invention.
Figure 6:
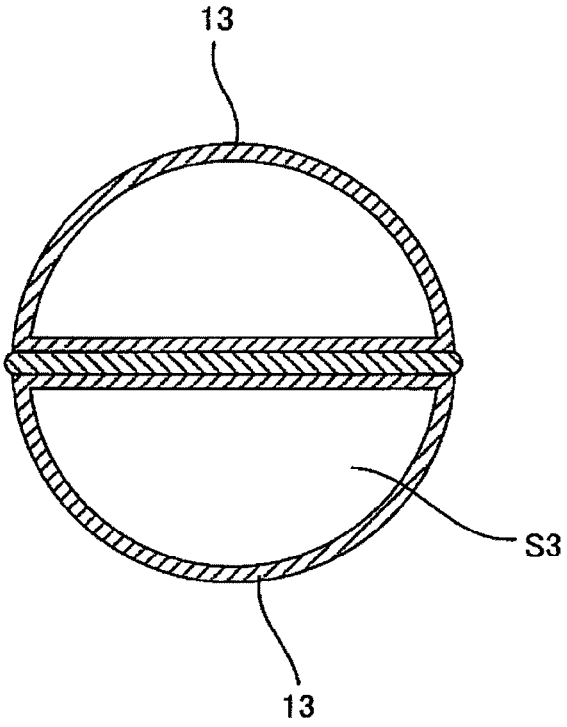
FIG. 6 is a cross-sectional view taken along the line VI-VI of FIG. 5.

FIGS. 5 and 6 illustrate a configuration of another example of the heating coil according to the embodiment of the invention. Elements common to those of the heating coil 1 will be referenced by common reference numerals and description thereof will not be repeated or will be simplified.

The heating coil 11 illustrated in FIGS. 5 and 6 is also a heating coil used for moving heating of an inner surface of a workpiece W and includes a head portion 2 which is inserted into the workpiece W and a pair of lead portions 13 which is formed to be inserted into the workpiece W.

The head portion 2 and the lead portions 13 are configured as pipe members forming a series of flow channels through which coolant flows. Different pipe members are used for the head portion 2 and the lead portions 13, the lead portions 13 are formed of a pipe member having a substantially semi-circular cross-section, and the cross-sectional area S3 of the flow channel inside each of the lead portions 13 is greater than the cross-sectional area S1 of the flow channel inside the head portion 2 (see FIG. 2). The pair of lead portions 13 has a substantially circular cross-section as a whole.

In this way, by approximating the cross-sectional shape of the pair of lead portions 13 to the cross-sectional shape of the inner space of the workpiece W, it is possible to effectively utilize the inner space of the workpiece W, to further increase the cross-sectional area of the flow channel inside the lead portion, and to further enhance the rigidity of the lead portion. When the rigidity of the lead portions is enhanced, it is possible to omit the reinforcing material and to reduce manufacturing costs of the heating coil.

Test examples for verifying the flow rate of the coolant by changing the cross-sectional area of the flow channel inside each of the lead portions will be described below.

The basic configurations of heating coils in Test Examples 1 to 3 are common to the above-mentioned heating coil 1 and the elements of the heating coil 1 will be appropriately referred to in the following description.

Figure 7:
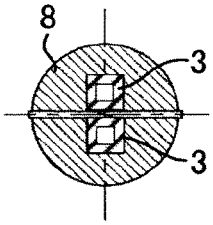
FIG. 7 is a diagram illustrating cross-sectional shapes of lead portions and coolant flow rates in test examples.
Figure 7:
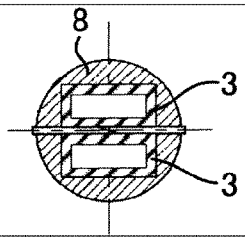
Figure 7:
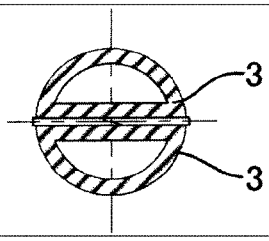

The heating coils according to Test Examples 1 to 3 are different from each other in the cross-sectional area of the flow channel inside each of the lead portions 3, and other configurations are the same. The cross-sectional shapes of the lead portions 3 of the heating coils according to Test Examples 1 to 3 are illustrated in FIG. 7.

In the heating coil according to Test Example 1, the lead portions 3 are formed of a pipe member having a substantially square cross-section which is the same as the head portion 2, and the cross-sectional area of the flow channel inside each of the lead portions 3 is equal to the cross-sectional area of the flow channel inside the head portion 2.

In the heating coil according to Test Example 2, the lead portions 3 are formed of a pipe member having a substantially rectangular cross-section, and the cross-sectional area of the flow channel inside each of the lead portions 3 is about three times the cross-sectional area of the flow channel inside the head portion 2.

In the heating coil according to Test Example 3, the lead portions 3 are formed of a pipe member having a substantially semi-circular cross-section, and the cross-sectional area of the flow channel inside each of the lead portions 3 is about five times the cross-sectional area of the flow channel inside the head portion 2.

The heating coils according to Test Examples 1 to 3 were supplied with a coolant at the same supply pressure and the flow rate of the coolant flowing in the heating coils was measured. The measurement result is also illustrated in FIG. 7.

As compared with the heating coil according to Test Example 1 in which the cross-sectional area of the flow channel inside each of the lead portions 3 is equal to the cross-sectional area of the flow channel inside the head portion 2, the heating coils according to Test Example 2 and Test Example 3 in which the cross-sectional area of the flow channel inside each of the lead portions 3 is relatively large provide the greater flow rate of the coolant flowing in the heating coils. From the measurement results, it was found that by setting the cross-sectional area of the flow channel inside each of the lead portions 3 to be relatively large, it is possible to increase the flow rate of the coolant flowing in the heating coil even when the supply pressure of the coolant is the same.

According to one or more embodiments of the present invention, a heating coil is configured to inductively heat an inner surface of a tubular workpiece. The heating coil heat the inner surface of the workpiece, and a pair of lead portions connected to one end of the head portion and the other end of the head portion respectively. The head portion and the lead portions are configured as pipe members forming a series of flow channels through which coolant flows. A cross-sectional area of the flow channel inside each of the lead portion is greater than a cross-sectional area of the flow channel inside the head portion.

The heating coil may further include connecting portions connecting the head portion and each of the lead portions, the connecting portions being tapered such that a cross-sectional area of a flow channel inside each of the connecting portions is gradually reduced toward the head portion.

The pair of lead portions may be formed to extend in parallel to each other so as to be inserted into the workpiece.

In a cross-section perpendicular to a direction in which the lead portions extend, a diameter of a smallest enclosing circle enclosing the pair of lead portions may be smaller than a diameter of a smallest enclosing circle enclosing the head portion and concentric with the smallest enclosing circle enclosing the pair of lead portions.

This application is based on Japanese Patent Application No. 2014-159404 filed on Aug. 5, 2014, the entire content of which is incorporated herein by reference.

The invention claimed is:

1. A heating coil configured to inductively heat an inner surface of a tubular workpiece, the heating coil comprising:

a head portion configured to be inserted into the workpiece and to inductively heat the inner surface of the workpiece;

a pair of lead portions connected to one end of the head portion and the other end of the head portion respectively; and connecting portions connecting the head portion and each of the lead portions, wherein the head portion and the lead portions are configured as pipe members forming a series of flow channels through which coolant flows, and wherein a cross-sectional area of the flow channel inside each of the lead portions is greater than a cross-sectional area of the flow channel inside the head portion, wherein the connecting portions are tapered.

2. The heating coil according to claim 1, wherein a cross-sectional area of a flow channel inside each of the connecting portions is gradually reduced toward the head portion.

3. The heating coil according to claim 1, wherein the pair of lead portions is formed to extend in parallel to each other so as to be inserted into the workpiece.

4. The heating coil according to claim 3, wherein, in a cross-section perpendicular to a direction in which the lead portions extend, a diameter of a smallest enclosing circle enclosing the pair of lead portions is smaller than a diameter of a smallest enclosing circle enclosing the head portion and concentric with the smallest enclosing circle enclosing the pair of lead portions.

5. The heating coil according to claim 2, wherein the pair of lead portions is formed to extend in parallel to each other so as to be inserted into the workpiece.

6. The heating coil according to claim 1, wherein the cross-sectional area of the flow channel inside each of the lead portions taken perpendicularly to a direction in which the coolant flows through each of the lead portions is greater than the cross-sectional area of the flow channel inside the head portion taken perpendicularly to a direction in which the coolant flows through the head portion.

7. The heating coil according to claim 1, wherein the pair of lead portions are formed to extend in parallel to each other along a length direction extending within the workpiece.

8. The heating coil according to claim 1, wherein the head portion has a rectangular cross section.

9. The heating coil according to claim 1, further comprising a reinforcing material covering the connecting portions.

* * * * *